US010654011B2

(12) United States Patent
Strömmer et al.

(10) Patent No.: US 10,654,011 B2
(45) Date of Patent: May 19, 2020

(54) HYDROFOIL IMPELLER

(71) Applicant: OUTOTEC (FINLAND) OY, Espoo (FI)

(72) Inventors: Ville Strömmer, Helsinki (FI); Markus Lehtonen, Lepsämä (FI)

(73) Assignee: OUTOTEC (FINLAND) OY, Espoo (FI)

( * ) Notice: Subject to any disclaimer, the term of this patent is extended or adjusted under 35 U.S.C. 154(b) by 136 days.

(21) Appl. No.: 15/523,863

(22) PCT Filed: Nov. 4, 2015

(86) PCT No.: PCT/FI2015/050757
§ 371 (c)(1),
(2) Date: May 2, 2017

(87) PCT Pub. No.: WO2016/071567
PCT Pub. Date: May 12, 2016

(65) Prior Publication Data

US 2018/0280901 A1 Oct. 4, 2018

(30) Foreign Application Priority Data

Nov. 6, 2014 (FI) ..... 20145971

(51) Int. Cl.
*B01F 7/00* (2006.01)
*B01F 7/22* (2006.01)
(Continued)

(52) U.S. Cl.
CPC ..... *B01F 7/001* (2013.01); *B01F 7/00375* (2013.01); *B01F 7/22* (2013.01);
(Continued)

(58) Field of Classification Search
CPC ..... B01F 7/001; B01F 7/00375; B01F 7/22; F04D 29/181; F04D 29/20; F04D 29/648
(Continued)

(56) References Cited

U.S. PATENT DOCUMENTS 2,460,902 A 2/1949 Odor
4,191,506 A * 3/1980 Packham ..... B64C 11/00 416/232
(Continued)

FOREIGN PATENT DOCUMENTS

GB 856 668 A 12/1960
JP 2005 08 7876 A 4/2005
(Continued)

OTHER PUBLICATIONS

Written Opinion of the International Searching Authority issued by the European Patent Office in relation to International Patent Application No. PCT/FI/2015/050757 dated Feb. 24, 2016 (6 pages).
(Continued)

*Primary Examiner* — Marc C Howell
(74) *Attorney, Agent, or Firm* — Robert P. Michal, Esq.; Carter, DeLuca & Farrell LLP

(57) ABSTRACT

A hydrofoil impeller includes a central hub connected to a shaft, and being in the form of a flat plate and being perpendicular to the central axis. The central hub has first bolt holes arranged to form a pattern, the number of groups of first bolt holes corresponding to a number of blades attached to the central hub. At least three blades extend radially outwardly from the central hub, and have a group of second bolt holes arranged in a corresponding pattern to the first bolt holes so that the group of second bolt holes can be aligned with the group of first bolt holes and bolts can be placed through the first and second bolt holes to form bolted joints. The pattern in which the first holes and second holes
(Continued)

are arranged in each of the respective groups of holes has a form of a closed curved shape.

6 Claims, 3 Drawing Sheets

(51) Int. Cl.
*F04D 29/20* (2006.01)
*F04D 29/64* (2006.01)
*F04D 29/18* (2006.01)

(52) U.S. Cl.
CPC ..... *F04D 29/181* (2013.01); *F04D 29/20* (2013.01); *F04D 29/648* (2013.01)

(58) Field of Classification Search
USPC ..... 366/343
See application file for complete search history.

(56) References Cited

U.S. PATENT DOCUMENTS 4,468,130 A * 8/1984 Weetman ..... B01F 7/00341 366/330.2
5,046,245 A 9/1991 Weetman et al.
5,326,226 A * 7/1994 Wyczalkowski ... B01F 7/00341 29/889.3
6,250,797 B1 * 6/2001 Weetman ..... B01F 3/04531 261/93
9,879,697 B2 * 1/2018 Strommer ..... F04D 29/181
2009/0231952 A1 * 9/2009 Higbee ..... B01F 3/04539 366/247
2010/0124147 A1 * 5/2010 Janz ..... B01F 7/001 366/343
2014/0211585 A1 * 7/2014 Maxon ..... B01F 7/22 366/279

FOREIGN PATENT DOCUMENTS

JP 2008248700 A 10/2008
KR 20030058882 A 7/2003
KR 101196450 B1 11/2012
WO WO-00/20109 A1 4/2000
WO WO-2015/082761 A1 6/2015

OTHER PUBLICATIONS

International Search Report issued by the European Patent Office acting as International Searching Authority in relation to International Patent Application No. PCT/FI2015/050757 dated Feb. 24, 2016 (4 pages).
Finnish Search Report issued by the Finnish Patent and Registration Office in relation to Finnish Application No. 20145971 dated May 19, 2015 (2 pages).

* cited by examiner

HYDROFOIL IMPELLER

CROSS-REFERENCE TO RELATED APPLICATIONS

This application is a National Phase Entry under 35 USC § 371 of PCT Patent Application Serial No. PCT/F12015/050757 filed Nov. 4, 2015, which claims priority to Finnish Patent Application No. 20145971, filed Nov. 6, 2014, the disclosure of each of these applications is expressly incorporated herein by reference in their entirety.

FIELD OF THE INVENTION

The present invention relates to a hydrofoil impeller for producing fluid flow in axial direction relative to a shaft rotating around its central axis in an agitated tank.

BACKGROUND OF THE INVENTION

In prior art, e.g. document JP 2005087876 discloses a hydrofoil impeller with three blades and comprising a central hub which is connected to a rotatable shaft. The central hub is in the form of a flat plate with a uniform thickness and being perpendicular to the central axis of the shaft. The central hub has three groups of four first bolt holes arranged to form a pattern. The number of groups of first bolt holes corresponds to the number of blades attached to the central hub. Thus, three blades extend radially outwardly from the central hub, each blade having a root portion. The root portion is in a form of a flat plate with a uniform thickness, said root portion has a group of four second bolt holes. The second bolt holes are arranged in a corresponding pattern in relation to the pattern of the first bolt holes so that the group of second bolt holes can be aligned with the group of first bolt holes and bolts can be placed through the first and second bolt holes to form bolted joints.

A problem with the attachment of blades to the central hub of the impeller with bolted joints wherein the bolts are arranged in linear rows is that the dynamic stresses caused by fluid forces, when the impeller is in operation during agitation of the fluid, are unevenly exerted at the bolted joints and the material of the hub and blades near to the bolted joints affecting strongly on the fatigue life of the impeller. Fatigue occurs when a material is subjected to repeated loading and unloading. If the loads are above a certain threshold, microscopic cracks will begin to form at the stress concentrators. Eventually a crack will reach a critical size, the crack will propagate suddenly, and the structure will fracture.

OBJECTIVE OF THE INVENTION

The objective of the invention is to alleviate the disadvantages mentioned above.

SUMMARY OF THE INVENTION

According to an aspect, the present invention provides a hydrofoil impeller for producing fluid flow in axial direction relative to a shaft rotating around its central axis in an agitated tank. The impeller comprises a central hub which is connected to the shaft. The central hub is in the form of a flat plate with a uniform thickness and is perpendicular to the central axis. The central hub has a number of groups of first bolt holes arranged to form a pattern, the number of groups of first bolt holes corresponding to a number of blades attached to the central hub. The impeller further comprises at least three blades extending radially outwardly from the central hub, each blade having a root portion. The root portion is in a form of a flat plate with a uniform thickness. The root portion has a group of second bolt holes arranged in a corresponding pattern in relation to the pattern of the first bolt holes so that the group of second bolt holes can be aligned with the group of first bolt holes and bolts can be placed through the first and second bolt holes to form bolted joints. According to the invention the number of holes in each group of first and second holes is at least five. The pattern to which the first holes and second holes are arranged in each of the respective groups of holes is in a form of a closed curved shape.

The advantage of the invention is that the arrangement of the pattern of holes and bolts in a form of a closed curved shape tends to equalize dynamic stresses caused by fluid forces acting on the impeller, which dynamic stresses, when the impeller is in use during agitation, are exerted at the bolted joints. The fatigue life of the impeller is improved. The arrangement of the invention also makes it possible to construct the impeller cost-effectively from a few parts with bolted joints without any need for welds, and also thereby improve the fatigue strength. The highest stress concentration factor of the new structure is significantly lower than old design has and new structure has only a few critical stress spots.

In one embodiment of the hydrofoil impeller, the central hub comprises an upper surface and a lower surface which is parallel to the upper surface. The root portion of each blade abuts against the lower surface of the central hub.

In one embodiment of the hydrofoil impeller, the number of the blades is three. The central hub has a form of a triangle with rounded corners. The group of first bolt holes is disposed at each corner of the central hub. The pattern in which the first holes and second holes are arranged in each of the respective groups of holes has a form of an ellipse. The central hub having a shape of a triangle has an advantage that the vertical flow of the fluid in the downwards direction near to the shaft and passing the central hub is substantially unobstructed by the central hub.

In one embodiment of the hydrofoil impeller, the number of the blades is five. The central hub has a form of a circular disc. The closed pattern in which the first holes and second holes are arranged in each of the respective groups of holes has a form of a circle.

In one embodiment of the hydrofoil impeller, impeller comprises five pieces of first spacer plates each of which has a pattern of bolt holes corresponding to the pattern of groups of first bolt holes and second bolt holes for each of the bolted joints. The first spacer plates are arranged against and underneath the root portion of the blade to form spacing elements for the bolted joints.

In one embodiment of the hydrofoil impeller, the impeller comprises five pieces of second spacer plates each of which has a pattern of bolt holes corresponding to the pattern of the bolt holes of the first spacer plate, and which second spacer plates are arranged against the upper surface of the central hub to form spacing elements for the bolted joints.

In one embodiment of the hydrofoil impeller, each blade comprises a leading edge and a trailing edge in the direction of the rotation. The attachment of the blade at the root portion provided by the closed curve shaped pattern of bolted joints provided by said first and second bolt holes and bolts is located, in the direction of the rotation, in front of and near to the side of the leading edge of the blade and substantially behind the trailing edge of the preceding blade.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Figure 1:
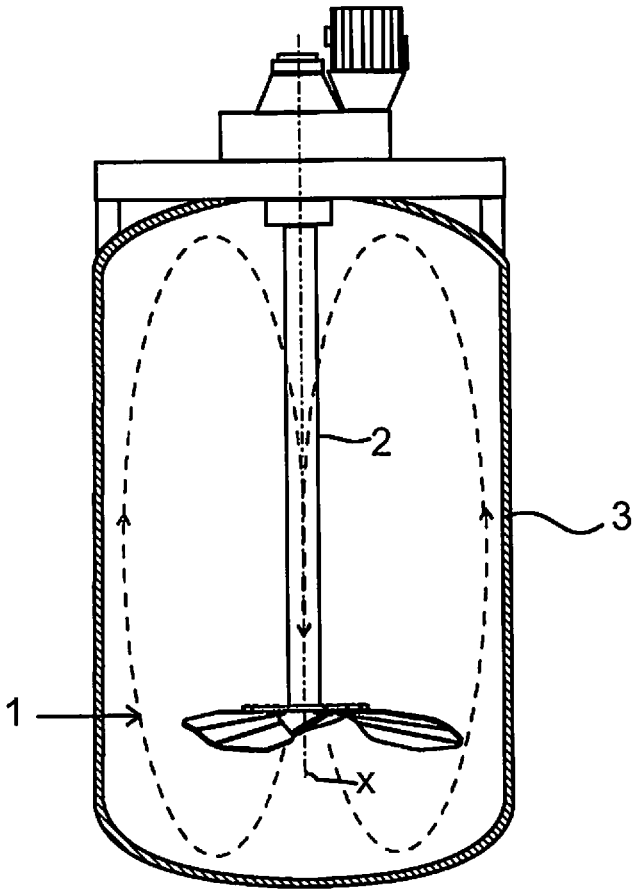
FIG. 1 is a schematic elevation side view of a reactor tank equipped with a first embodiment of the impeller in accordance of the invention.

In FIG. 1 is shown a hydrofoil impeller 1 for producing fluid flow in axial direction relative to a shaft 2 rotating around its central axis x in an agitated tank 3.

Referring to FIGS. 2 to 7, the impeller 1 comprises a central hub 4. The central hub 4 is connected to the shaft 2. Preferably, the central hub 4 has a central hole to which the shaft 2 is attached by an interference fit. Also any other suitable connecting means may alternatively be used, including welding. However, while it is an objective to improve fatigue life, welding is preferably avoided. The central hub 4 has a form of a flat plate with a uniform thickness. The central hub 4 is perpendicular to the central axis x. The central hub 4 has a number of groups of first bolt holes 5 arranged to form a pattern. The number of groups of first bolt holes corresponds to the number of blades 6 attached to the central hub 4. In the embodiment shown in FIGS. 1 to 4, the number of blades 6 is three. In the embodiment shown in FIGS. 5 to 7, the number of blades 6 is five.

The blades 6 extend radially outwardly from the central hub 4. Each blade 6 has a root portion 7. The root portion 7 is in a form of a flat plate with a uniform thickness. In the shown two embodiments the whole blades are in a form of a flat plate with a uniform thickness. Each of the blades has three straight bends which divide the blades to four planar angled successive profile portions.

The root portion 7 of the blade has a group of second bolt holes 8 which are arranged in a corresponding pattern in relation to the pattern of the first bolt holes so that the group of second bolt holes 8 can be aligned with the group of first bolt holes 5 and bolts 9 can be placed through the first and second bolt holes to form bolted joints.

The number of holes in each group of first and second holes is at least five. In the preferred embodiments shown in Figures the number of holes in each group of first and second holes is eight. The pattern in which the first holes 5 and second holes 8 are arranged in each of the respective groups of holes is in a form of a closed curved shape. The closed curved shape can be an ellipse or a circle.

Figure 2:
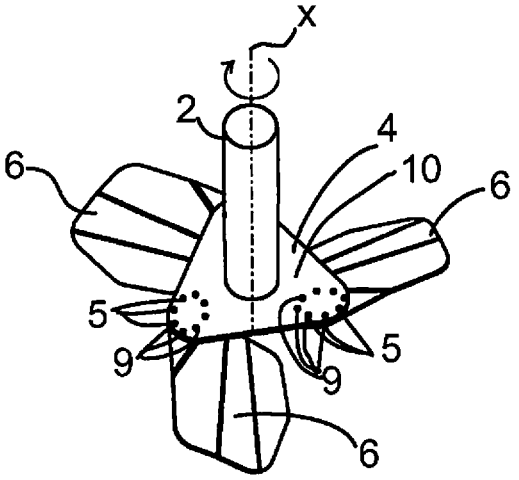
FIG. 2 is an axonometric view of the first embodiment of the impeller of the invention seen obliquely from above.
Figure 3:
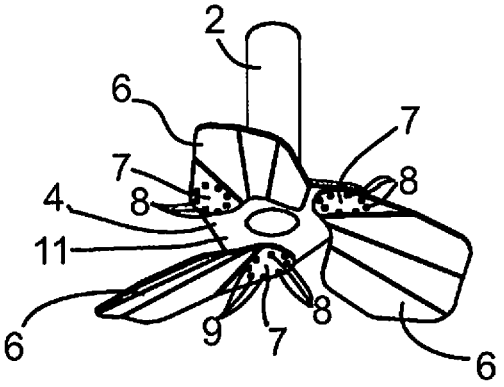
FIG. 3 is an axonometric view of the impeller of FIG. 2 seen obliquely from below.
Figure 5:
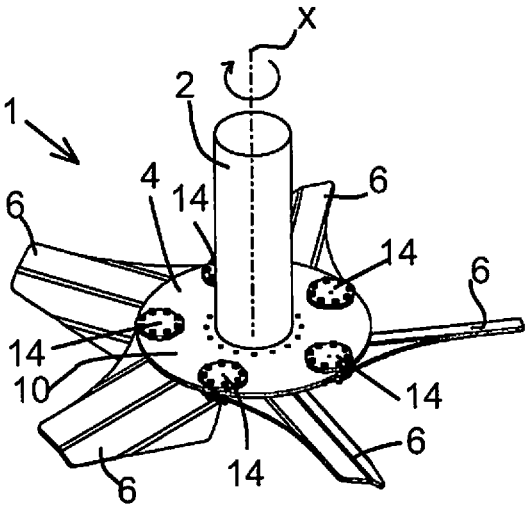
FIG. 5 is an axonometric view of an impeller in accordance of a second embodiment of the invention seen obliquely from above.
Figure 6:
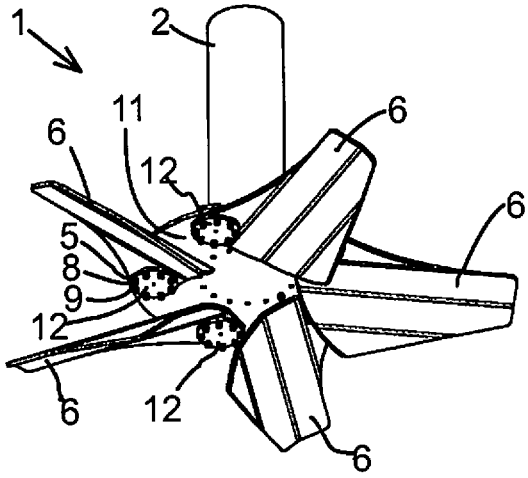
FIG. 6 is an axonometric view of the impeller of FIG. 5 seen obliquely from below.
Figure 10:
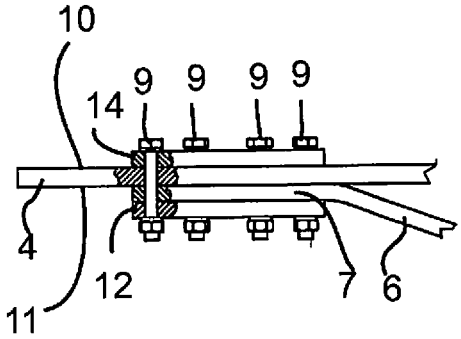
FIG. 10 is a section X-X taken from FIG. 7.

As can be seen especially in FIGS. 2 and 3 for the first embodiment of the impeller and in FIGS. 5, 6, and 10 for the second embodiment of the impeller, the central hub 4 comprises an upper surface 10 and a lower surface 11 which is parallel to the upper surface. The root portion 7 of each blade 6 is abutted against the lower surface 11 of the central hub 4.

Figure 4:
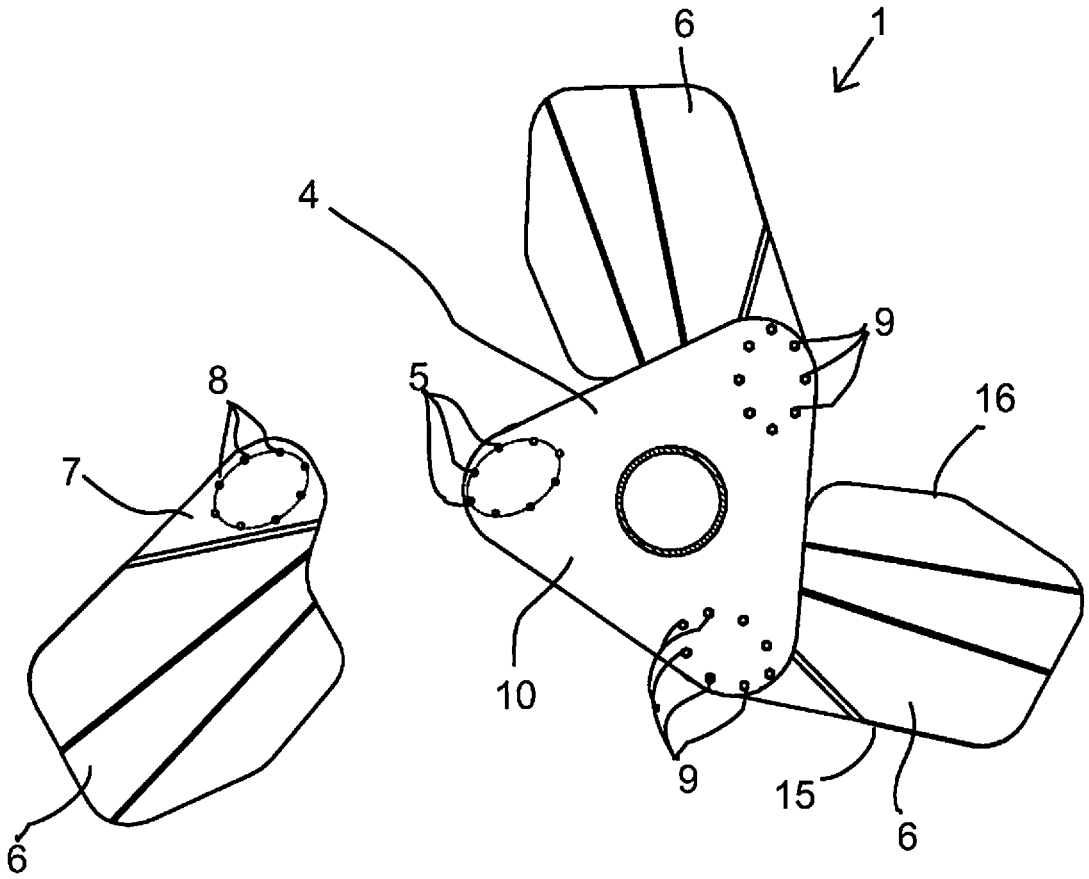
FIG. 4 is a top view of the impeller of FIGS. 2 and 3, with one of the blades shown as detached.

In the embodiment shown in FIGS. 2 to 4, the number of the blades 6 is three. The central hub 4 has a form of a triangle with rounded corners. The group of first bolt holes 5 is disposed at each corner of the central hub 4. The pattern in which the first holes 5 and second holes 8 are arranged in each of the respective groups of holes is in a form of an ellipse.

Figure 7:
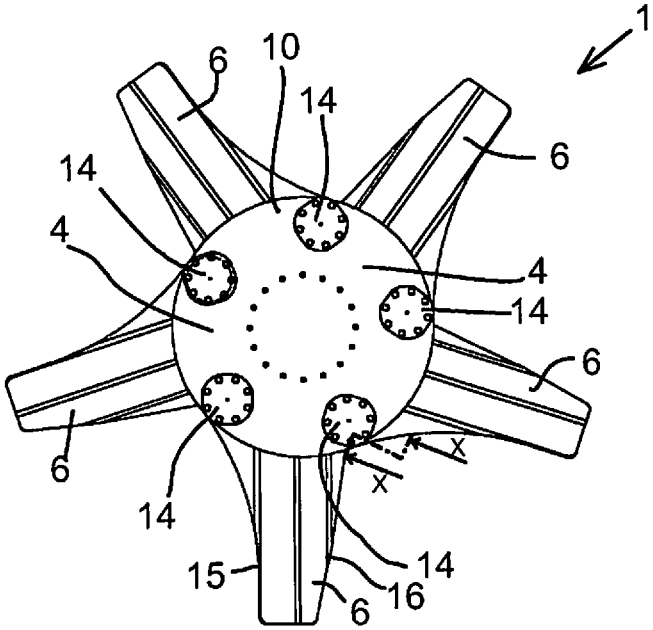
FIG. 7 is a top view of the impeller of FIGS. 5 and 6.

In the embodiment shown in FIGS. 5 to 7, the number of the blades 6 is five. The central hub 4 is in the form of a circular disc. The pattern, in which the first holes 5 and second holes 8 are arranged in each of the respective groups of holes, has a form of a circle.

Figure 8:
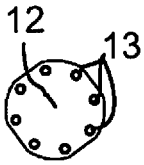
FIG. 8 is a plan view of the first spacer plate.
Figure 9:
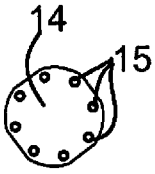
FIG. 9 is a plan view of the second spacer plate.

Referring to FIGS. 5 to 10, the impeller 1 comprises five pieces of first spacer plates 12, one of which is shown separately in FIG. 8. Each first spacer plate 12 has a pattern of bolt holes 13 corresponding to the pattern of groups of first bolt holes 5 and second bolt holes 8 for each of the bolted joints. As can be seen from FIGS. 6 and 10, the first spacer plates 12 are arranged against and underneath the root portion 7 of the blade 6 to form spacing elements for the bolted joints. The impeller 1 also comprises five pieces of second spacer plates 14, one of which is shown separately in FIG. 9. Each second spacer plate 14 has a pattern of bolt holes 15 corresponding to the pattern of the bolt holes 13 of the first spacer plate 12, and which second spacer plates 14 are arranged against the upper surface 11 of the central hub 4 to form spacing elements for the bolted joints. The spacer plates 12 and 14 used together with the central hub 4 and the root portion 7 give a suitable elongation length for the bolts 9 to enhance their fatigue strength.

Referring to FIGS. 4 and 7, each blade 6 comprises a leading edge 15 and a trailing edge 16 in the direction of the rotation. The attachment of the blade 6 at the root portion 7 provided by the closed curve (i.e. ellipse or circle) shaped pattern of bolted joints provided by said first and second bolt holes 5, 8 and bolts 9 is located, in the direction of the rotation, in front of and near to the side of the leading edge 15 of the blade 6 and substantially behind the trailing edge 16 of the preceding blade.

While the present invention has been described in connection with an exemplary embodiment, and implementations, the present invention is not so limited, but rather covers various modifications, and equivalent arrangements, which fall within the purview of prospective claims.

The invention claimed is:

1. A hydrofoil impeller for producing fluid flow in an axial direction relative to a shaft rotating around its central axis in an agitated tank, the impeller comprising:

a central hub which is connected to the shaft, the central hub being in the form of a flat plate with a uniform thickness and being perpendicular to the central axis (x), the central hub having a number of groups of first bolt holes arranged to form a pattern, the number of groups of first bolt holes corresponding to a number of blades attached to the central hub; and at least three blades extending radially outwardly from the central hub, each blade having a root portion, the root portion being in a form of a flat plate with a uniform thickness, the root portion having a group of second bolt holes arranged in a corresponding pattern in relation to the pattern of the first bolt holes so that the group of second bolt holes can be aligned with the group of first bolt holes and bolts can be placed through the first and second bolt holes to form bolted joints, wherein the number of holes in each group of first and second holes is at least five, wherein the pattern in which the first holes and second holes are arranged in each of the respective groups of holes is in a form of a closed curved shape, wherein each blade comprises a leading edge and a trailing edge in the direction of the rotation, and the attachment of the blade at the root portion provided by the closed curve shaped pattern of bolted joints provided by the first and second bolt holes and bolts is located, in the direction of rotation, in front of a midpoint of the blade defined between the leading edge and trailing edge of the blade.

2. The hydrofoil impeller according to claim 1, wherein the central hub comprises an upper surface and a lower surface which is parallel to the upper surface, and the root portion of each blade abuts against the lower surface of the central hub.

3. The hydrofoil impeller according to claim 1, wherein the number of the blades is three, the central hub is in the form of a triangle with rounded corners, the group of first bolt holes is disposed at each corner of the central hub, and the pattern in which the first holes and second holes are arranged in each of the respective groups of holes is in the form of an ellipse.

4. The hydrofoil impeller according to claim 1, wherein the number of the blades is five, the central hub is in the form of a circular disc, and the pattern in which the first holes and the second holes are arranged in each of the respective groups of holes is in a form of a circle.

5. The hydrofoil impeller according to claim 4, wherein the impeller comprises five pieces of first spacer plates each of which has a pattern of bolt holes corresponding to the pattern of groups of first bolt holes and second bolt holes for each of the bolted joints, and which first spacer plates are arranged against and underneath the root portion of the blade to form spacing elements for the bolted joints.

6. The hydrofoil impeller according to claim 5, wherein the impeller comprises five pieces of second spacer plates each of which has a pattern of bolt holes corresponding to the pattern of the bold holes of the first spacer plate, and which second spacer plates are arranged against the upper surface of the central hub to form spacing elements for the bolted joints.

* * * * *